United States Patent [19]

King

[11] Patent Number: 4,813,100

[45] Date of Patent: Mar. 21, 1989

[54] CLOSURE CHECK

[76] Inventor: Daniel P. King, 635 San Pablo, SE., Albuquerque, N. Mex. 87108

[21] Appl. No.: 152,258

[22] Filed: Feb. 4, 1988

[51] Int. Cl.[4] ..... E05F 3/00; E05F 5/00

[52] U.S. Cl. ..... 16/49; 16/82; 16/DIG. 17; 267/64.12

[58] Field of Search ..... 16/49, 51, 66, 82, 84, 16/85, DIG. 9, 10, 17; 267/64.12

[56] References Cited

U.S. PATENT DOCUMENTS

| | | | |
|---|---|---|---|
| 3,708,825 | 1/1973 | Wood | 16/49 |
| 4,048,695 | 9/1977 | Juilfs et al. | 16/65 |
| 4,078,779 | 3/1978 | Molders | 267/120 |
| 4,430,770 | 2/1984 | Niekrasz et al. | 16/80 |
| 4,449,702 | 5/1984 | Hasegawa | 267/64.12 |
| 4,596,383 | 6/1986 | Howard | 16/84 |
| 4,723,765 | 2/1988 | Pearson | 267/64.12 |
| 4,744,548 | 5/1988 | Hathaway | 267/64.12 |

FOREIGN PATENT DOCUMENTS

| | | | |
|---|---|---|---|
| 2335136 | 7/1977 | France | 267/64.12 |
| 14636 | 2/1981 | Japan | 267/64.12 |

*Primary Examiner*—Nicholas P. Godici
*Assistant Examiner*—Edward A. Brown
*Attorney, Agent, or Firm*—Deborah A. Peacock; Robert W. Weig

[57] ABSTRACT

A closure check for temporarily bracing open a conventional cylinder/piston mechanism. The closure check comprises a longitudinal brace, positioning means, engagement means and disengagement means. The closure check can automatically engage with the cylinder/piston mechanism or can be engaged manually by a user.

8 Claims, 3 Drawing Sheets

CLOSURE CHECK

FIELD OF THE INVENTION

The invention relates to a closure check for temporarily bracing open a conventional cylindrical opening and closing device, the closure check having a tubular longitudinal brace, positioning means at one end, engagement means at the other end, and means for disengaging the closure check without removing it from the cylindrical opening and closing device.

BACKGROUND OF THE INVENTION

In a variety of situations, there exist apertures with appurtenant covers, such as doors, windows, automobile hatchbacks, hoods, and trunks. For many of these apertures, it is frequently desirable to be able to maintain the appurtenant cover in an open or closed position. Springs are commonly used in the art to assist in closure of such a cover. However, the use of springs quite commonly allows the door or other cover to "slam" closed. This reduces the life of the door, causes unpleasant noises and harms objects that are within the path of the quickly moving door.

Conventional cylindrical opening and closing devices such as fluid (most commonly gas) or spring-biased cylinder/piston mechanisms are frequently utilized in the art to effect the opening and closing of a cover of an aperture in a smooth, attenuated manner or to support a door, hatch, or the like in an open position. It is often desirable to have repeated access to the opening and space therein and, therefore, necessary to brace the cylinder/piston mechanism. If the cylinder/piston mechanism is biased toward a closed position, the brace should act in a manner to preclude the mechanism's normal retraction. If, however, the mechanism is biased toward an open position, the brace should preclude any external force such as wind or application of weight from effecting a closure of the cylinder.

Even when a cylinder/piston mechanism is utilized to hold a cover open, the mechanism may close or retract due to various reasons. At times, external forces which are not applied by the user, such as wind or weight on a hatch or door, may act to close the hatch or door when a user desires to have it remain open. For example, snow or ice build-up on a hatchback and the accompanying weight can override the open bias of the cylinder/piston mechanism and cause it to close. The weight of the hatch, itself, is frequently more than the cylinder/piston mechanism is designed to hold open. Further, in cold weather, a gas cylinder/piston mechanism does not hold as well as it does in warmer weather. Another problem is that cylinder/piston mechanisms, as other mechanical devices, simply wear out with use and will not stay open. In automobiles more than a few years old, or those having frequently opened hatches, these mechanisms often will not remain open. Replacement mechanisms are expensive and thus it is desirable to have an inexpensive means to prevent a mechanism from closing.

In the prior art, a variety of devices have been utilized to assist in keeping the cylinder/piston mechanism in the extended or open position. One such device, used with horizontally mounted mechanisms, particularly with screen doors, consists of a washer that has a small protuberance on the edge adjacent to the cylinder. The inner diameter of this washer is slightly larger than the diameter of the piston and the washer encompasses the piston. When it is desired that the door remain in an open position, the washer can be moved, manually, to a position adjacent to the cylinder wherein the protuberance prevents the piston from retracting into the cylinder. However, this prior art device is not useful with a non-horizontally mounted cylinder, in that the washer may fall due to gravity.

U.S. Pat. No. 4,078,779, entitled "PNEUMATIC SPRING WITH MANUALLY RELEASABLE STOP," to Molders; and No. 4,430,770, entitled "DOOR OPERATING MECHANISM," to Niekrasz, et al., disclose devices which are utilized in preventing the closure of a cylinder/piston mechanism. The '770 patent discloses a hinge modification, which, by manual manipulation of the piston end to an alternate position, precludes the bias of the cylinder from retracting the piston within the cylinder. The '779 patent discloses a permanently attached sleeve which fits over both the piston and cylinder, and, by means of a spring-actuated turning device, couples with a pin attached to the cylinder to cause the cylinder to remain in a semi-extended position. Neither of these patents discloses a device for checking the closure of a bias cylinder with a readily attachable and detachable apparatus which may be used on either horizontally- or vertically-mounted, biased cylinders.

SUMMARY OF THE INVENTION

In accordance with the present invention, there is provided a closure check for bracing a conventional cylindrical opening and closing device, such as a fluid or spring-biased cylinder piston mechanism. A conventional cylindrical opening and closing device comprises a cylinder having a top, a base and a piston having a piston rod which extends from the base of the cylinder. The top of the cylinder is affixable to a first mount. The extending end of the piston rod is affixable to a second mount.

The closure check of the invention comprises a generally tubular longitudinal brace comprising two ends, means for positioning one end of the longitudinal brace in the vicinity of the second mount of the extending end of the piston rod, means for a user to engage the other end of the longitudinal brace with the cylinder to brace open the cylindrical opening and closing device, and means for a user to disengage the longitudinal brace in a storage, non-biasing position without removing it from the longitudinal brace.

The longitudinal brace of the closure check preferably has an inside diameter which is sufficiently larger than the outside diameter of the cylinder so that the longitudinal brace can achieve a storage position by sliding over the cylindrical opening and closing device.

In a preferred embodiment, one end of the longitudinal brace is affixed to the extending end of the piston rod. For example, the pin at the extending end of the piston rod for mounting the piston rod can also be utilized to position the closure check. In the preferred embodiment, the longitudinal brace comprises a keyhole-shaped slot for positioning the brace on a pin or bolt of the extending end of the piston rod.

Preferably, the closure check comprises a longitudinal slot for removably positioning the longitudinal base on the cylindrical opening and closing device (most preferably on the piston rod). The longitudinal slot may be open or it may be covered.

The closure check may comprise means for spring biasing the longitudinal brace so that engagement with the base of the cylinder is not automatic, but must be performed manually. Alternatively, the longitudinal brace may automatically engage with the base of the cylinder by the force of gravity or by means of a spring-actuated displacement means, a weight or the like.

One object of the present invention is to provide a readily detachable and attachable means for preventing the piston of a biased cylindrical opening and closing device from retracting into the cylinder.

A further object of the invention is to provide a closure check which will function with cylindrical opening and closing devices mounted in any orientation.

One advantage of the present invention is that it is simple in design, easy to manufacture, easy to use and economical.

Other objects, advantages and novel features, and further scope of applicability of the present invention will be set forth in part in the detailed description to follow, taken in conjunction with the accompanying drawing, and in part, will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which is incorporated in and forms a part of the specification, illustrates several embodiments of the present invention and, together with the description, serves to explain the principles of the invention. In the drawing.

DETAILED DESCRIPTION OF THE INVENTION

Figure 1:
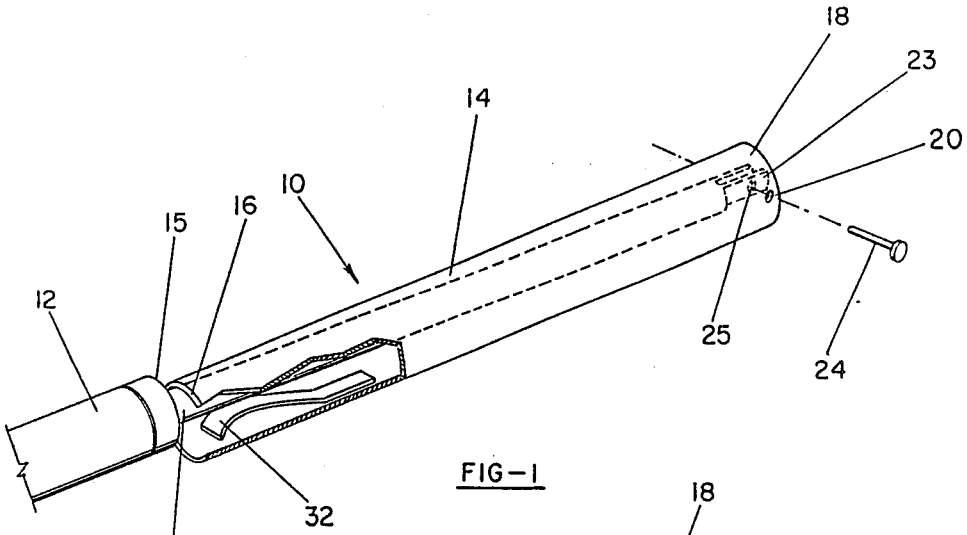
FIG. 1 is an isometric view illustrating one embodiment of the invention attached to a conventional cylindrical opening and closing device.

This invention relates to a closure check for use in preventing retraction of a piston in a conventional cylindrical opening and closing device, such as a fluid or spring-biased cylinder/piston mechanism, having a cylinder 12 and a piston having a piston rod 22. In the drawing, the base end 15 of the cylinder is shown as the end from which the piston rod 22 extends. The top of the cylinder which affixes to a mount is not shown. The distal end 23 of the piston rod 22 is attachable to another mount (not shown).

The invention comprises a generally tubular longitudinal brace which attaches to a conventional cylindrical opening and closing device. The invention further comprises positioning, engaging and disengaging means to brace open and allow closure of the cylindrical opening and closing device.

Reference is now made to FIG. 1 of the drawing which illustrates one closure check embodiment of the invention 10 being utilized with a conventional cylindrical opening and closing device. The closure check comprises a generally tubular longitudinal brace 14 having two ends 16 and 18, which comprise, respectively, engagement and positioning ends of the longitudinal brace 14. As used throughout the specification and claims, the terms "tube" or "tubular" mean a hollow elongation which is generally circular, elliptical, triangular, rectangular, polygonal, or the like, in cross section. In the embodiment shown in FIG. 1, the positioning end 18 comprises two apertures 20 (only one shown in the drawing), which allow attachment of the longitudinal brace 14 to the distal end 23 of the piston rod 22 by means of a pin or bolt 24, commonly used in mounting the piston rod 22, which passes through an aperture or apertures 25 at the distal end 23 of the piston rod 22.

FIG. 1 of the drawing also illustrates engagement means comprising a spring clip 32, which causes the longitudinal brace 14 to automatically engage with the base end 15 of the cylinder 12 when the cylindrical opening and closing device is opened, thereby preventing the cylindrical opening and closing device from closing. To close the cylindrical opening and closing device utilizing the closure check embodiment shown in FIG. 1, the user must manually press or push on the engagement end 16 of the longitudinal brace 14, thereby disengaging the longitudinal brace 14 and allowing the piston rod 22 to retract into the cylinder 12. Upon retraction, the longitudinal brace 14 slides over and is positioned on the exterior of the cylinder 12. (See FIG. 6.) Other engagement means, such as a weight (not shown) placed on the engagement end of the longitudinal brace, can also be used in accordance with the invention. The invention is not limited to the particular engagement means shown in the drawing.

Figure 2:
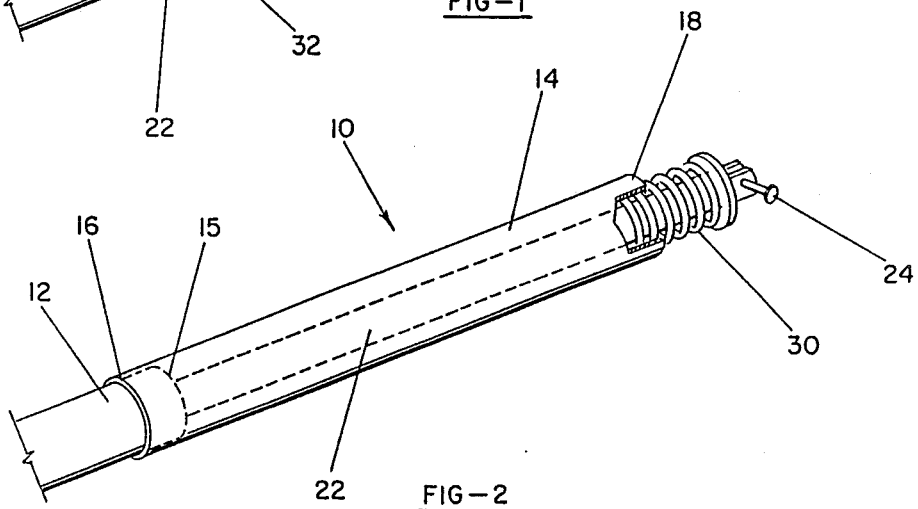
FIG. 2 is an isometric view illustrating an alternative embodiment of the invention having a spring-biased storage means and attached to a conventional cylindrical opening and closing device.

FIG. 2 of the drawing illustrates an alternative closure check 10 of the invention comprising a spring 30. The spring 30 serves to maintain the longitudinal brace 14 in a storage position (resting on the exterior of the cylinder 12) when the cylindrical opening and closing device is opened. In order to engage the longitudinal brace 14 in order to hold the cylindrical opening and closing device open, a user must push the longitudinal brace 14 towards the spring 30 so that the engagement end 16 of the longitudinal brace 14 clears the cylinder 12. The engagement end 16 of the longitudinal brace 14 is then pushed or allowed to fall so that the engagement end 16 engages with the base end 15 of the cylinder 12 as shown in FIG. 1. To disengage the longitudinal brace 14, the user pushes on the engagement end 16 and towards the spring 30 to allow the longitudinal brace 14 to slide over the cylinder 12 and the piston rod 22 to retract.

Figure 3:
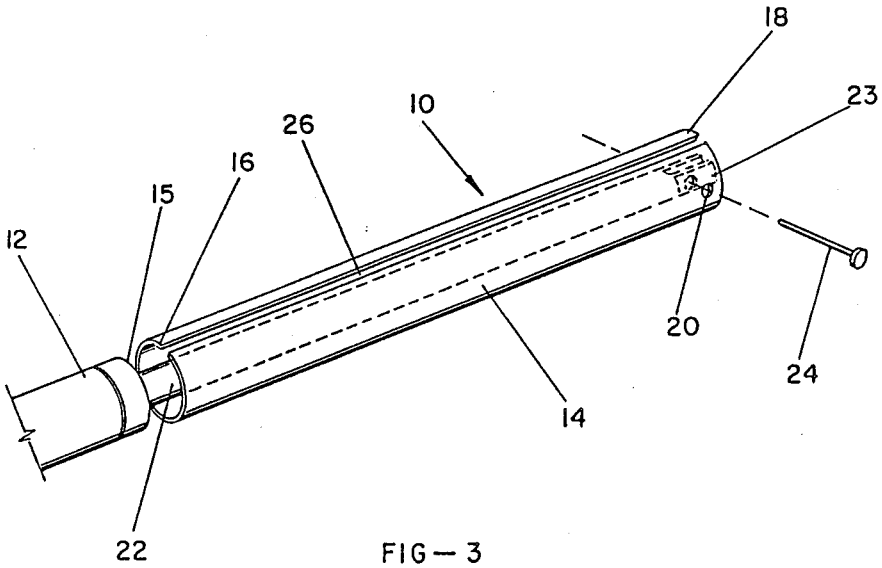
FIG. 3 is an isometric view illustrating an alternative embodiment of the invention having a longitudinal slot and attached to a conventional cylindrical opening and closing device.

FIG. 3 of the drawing illustrates an alternative closure check 10 of the invention comprising a longitudinal slot 26. This slot 26 allows the longitudinal brace 14 to be readily slipped on or off of the piston rod 22 or cylinder 12 for installation of the closure check 10.

FIGS. 3–8 of the drawing do not show any particular engagement means such as shown in FIG. 1 (spring clip 32) or FIG. 2 (spring 30). If the closure check 10 and cylindrical opening and closing device are mounted in any non-vertical position, the longitudinal brace 14 can automatically engage with the base end 15 of the cylinder 12 when the cylindrical opening and closing device is opened due to the force of gravity; the engagement end 16 of the longitudinal brace 14 will automatically fall and engage with the base end 15 of the cylinder 12.

FIGS. 4–8 of the drawing show closure check embodiments of the invention which are readily attachable to and detachable from the piston rod 22 (or cylinder 12) of the cylindrical opening and closing device. These figures also illustrate various positioning means. Utilizing these embodiments, a user does not need to disassemble and reassemble the cylindrical opening and closing device in order to install the closure check 10. The longitudinal slot 26 enables a user to slip the closure check 10 directly onto the piston rod 22.

Figure 4:
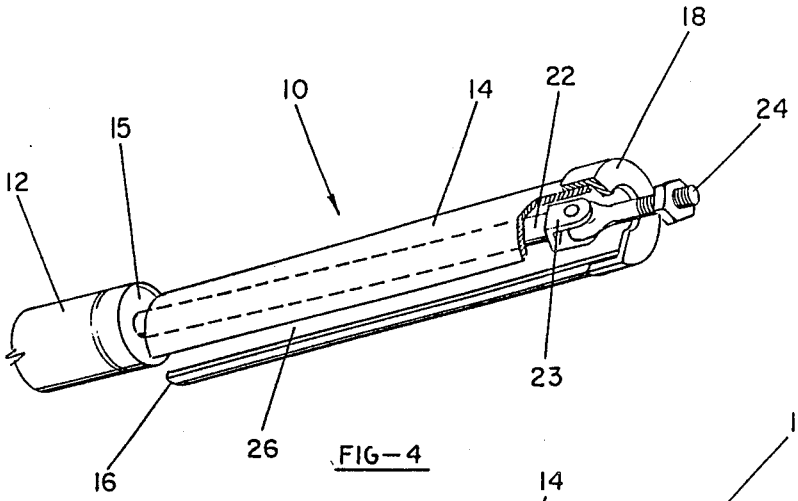
FIG. 4 is an isometric view of yet another alternative embodiment of the invention having a longitudinal slot and attached to a conventional cylindrical opening and closing device.

FIG. 4 of the drawing illustrates a closure check 10 wherein the longitudinal brace 14 engages with the pin 24 at the distal end 23 of the piston rod 22. The longitudinal slot 26 at the positioning end 18 slips over the pin 24, and when rotated, positions the longitudinal brace 14 in a fixed position relative to the piston rod 22.

Figure 5:
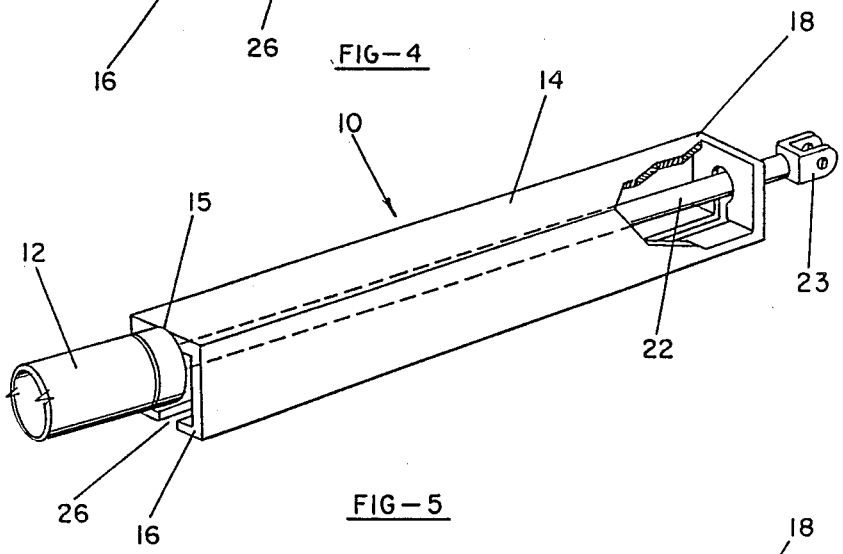
FIG. 5 is an isometric view of still another embodiment of the invention having a square cross-sectional shape and attached to a conventional cylindrical opening and closing device.

FIG. 5 of the drawing illustrates an alternative square cross-sectional shape for the longitudinal brace 14. The positioning means is similar to that shown in FIG. 4.

Figure 6:
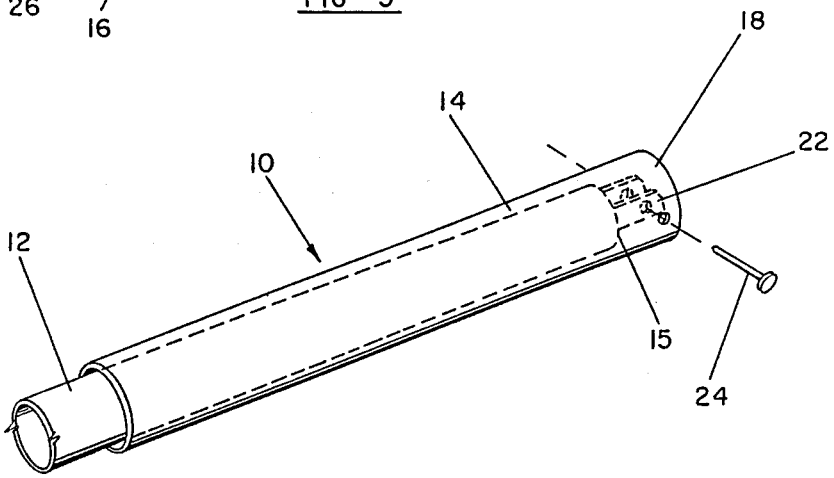
FIG. 6 is an isometric view of the embodiment of FIG. 1 in a retracted position on a conventional cylindrical opening and closing device.

FIG. 6 of the drawing shows the closure check 10 of FIG. 1 in a storage position. The piston rod 22 is retracted in the cylinder 12 and the longitudinal brace 14 is positioned on the exterior of the cylinder 12.

Figure 7:
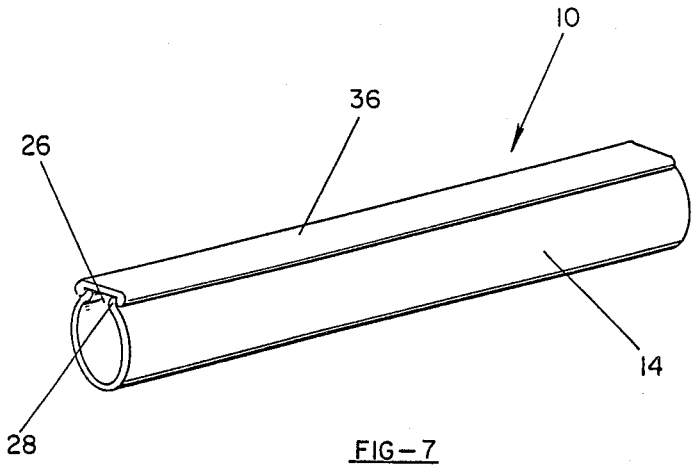
FIG. 7 is an isometric view illustrating an alternate embodiment of the invention having a cover over a longitudinal slot.

FIG. 7 of the drawing shows an alternative closure check 10 of the invention comprising a longitudinal slot 26 with flanges 28, which engage with a slot cover 36.

Figure 8:
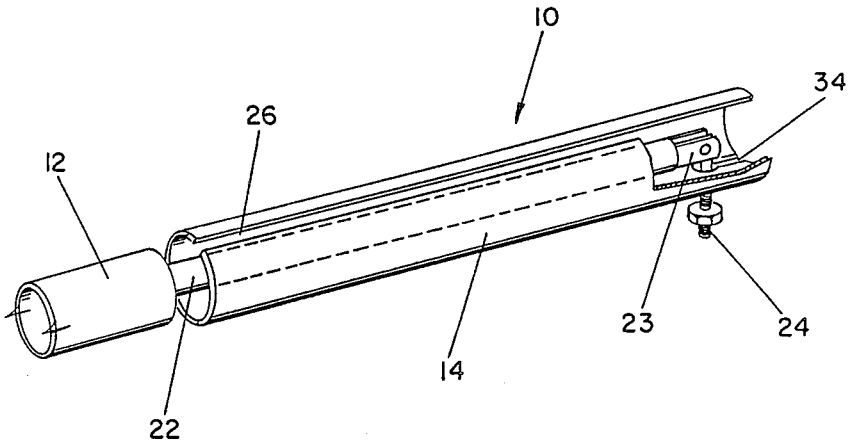
FIG. 8 is an isometric view of the preferred embodiment of the invention.

FIG. 8 of the drawing illustrates the preferred embodiment of the invention comprising a longitudinal slot 26 and a keyhole-shaped opening 34 which engages with the pin or bolt 24 by sliding the keyhole-shaped opening 34 over the pin or bolt 24.

The closure check of the invention can be constructed of any rigid or semi-rigid material such as plastic, metal or rubber.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A closure check for temporarily bracing open a conventional cylindrical opening and closing device, the cylindrical opening and closing device comprised of a cylinder having a top and a base, the top of the cylinder being affixable to a first mount, the cylinder containing a piston having a piston rod extending therefrom through the base of the cylinder and the extending end of the piston rod being affixable to a second mount, said closure check comprising:

(a) a generally tubular longitudinal bracing means comprising two ends, said generally tubular longitudinal bracing means comprising a longitudinal slot whereby said generally tubular longitudinal bracing means is removably positionable over the cylindrical opening and closing device;

(b) means for positioning one end of said generally tubular longitudinal bracing means in the vicinity of the second mount of the extending end of the piston rod;

(c) means for a user to engage the other end of said generally tubular longitudinal bracing means with the cylinder to brace open the cylindrical opening and closing device; and (d) means for a user to disengage said generally tubular longitudinal bracing means in a storage, non-bracing position without removing it from the cylindrical opening and closing device.

2. The closure check of claim 1 wherein said longitudinal slot within said generally tubular longitudinal bracing means is structured to make said generally tubular longitudinal bracing means removably positionable over the piston rod of the cylindrical opening and closing device.

3. The closure check of claim 1 wherein said generally tubular longitudinal bracing means comprises means for spring biasing said generally tubular longitudinal bracing means into its storage position, whereby a user can, by pushing against the spring bias, maneuver said generally tubular longitudinal bracing means into its bracing position.

4. The closure check of claim 1 wherein said positioning means of said generally tubular longitudinal bracing means is rotatably affixable in the vicinity of the second mount.

5. The closure check of claim 1 wherein said engagement means of said generally tubular longitudinal bracing means is weighted whereby said generally tubular longitudinal bracing means is movable into its bracing position by the force of gravity.

6. The closure check of claim 1 wherein said engagement means of said generally tubular longitudinal bracing means is movable into its bracing position by the force of gravity acting upon said generally tubular longitudinal bracing means.

7. The closure check of claim 1 wherein said longitudinal slot comprises flanges whereby said generally longitudinal bracing means is removably positionable over the cylindrical opening and closing device and a slot cover is attachable to said flanges of said slot.

8. The closure check of claim 1 wherein said means for positioning one end of said generally tubular longitudinal bracing means in the vicinity of the second mount of the extending end of the piston rod comprises a keyhole-shaped slot which is affixable to the extending end of the piston rod.

* * * * *